United States Patent [19]

Ashenfelter

[11] Patent Number: 4,576,555

[45] Date of Patent: Mar. 18, 1986

[54] OIL DISPERSING DEVICE

[75] Inventor: Roger N. Ashenfelter, Adrian, Mich.

[73] Assignee: Tecumseh Products Company, Tecumseh, Mich.

[21] Appl. No.: 670,314

[22] Filed: Nov. 13, 1984

[51] Int. Cl.[4] ..... F04B 39/02; F04B 39/06

[52] U.S. Cl. ..... 417/372; 417/902

[58] Field of Search ..... 417/372, 902; 418/DIG. 1, 94; 184/6.16, 6.18, 6.22, 6.28

[56] References Cited

U.S. PATENT DOCUMENTS

| | | | |
|---|---|---|---|
| 2,113,691 | 4/1938 | Heller | 417/372 X |
| 2,138,664 | 11/1938 | Money | 417/372 |
| 2,298,749 | 10/1942 | Buschmann | 417/372 |
| 2,504,747 | 4/1950 | Steenstrup | 417/372 |
| 3,295,753 | 1/1967 | Butts et al. | 417/902 X |
| 3,454,213 | 7/1969 | Valbjorn | 417/902 |

*Primary Examiner*—Carlton R. Croyle
*Assistant Examiner*—Theodore W. Olds
*Attorney, Agent, or Firm*—Albert L. Jeffers; Anthony Niewyk

[57] ABSTRACT

An oil dispersing device in a compresser having a crankshaft with an axial bore therein. An oil pumping device pumps oil upwardly through the axial bore and outwardly through a radial passage communicating with the bore. A cage bearing located in an upper portion of the compressor housing and journalling the crankshaft has a counterbore formed therein which is coaxial with and surrounds the crankshaft and forms an annulus with the outer surface of the crankshaft. Oil passing outwardly through the radial passage pools in the annulus and deflects additional oil exiting from the passage thereby deflecting oil upwardly onto the upper housing wall whereby the oil is cooled by the compressor housing.

13 Claims, 6 Drawing Figures

OIL DISPERSING DEVICE

BACKGROUND OF THE INVENTION

This invention relates to a compressor for a refrigeration system and more particularly to a compressor oil lubrication system wherein oil is slung outwardly from the compressor crankshaft and is deflected upwardly onto the top wall of the compressor shell by means of a counterbore in the outboard bearing so that heat energy is transferred from the compressor oil to the compressor housing.

In hermetic compressors of the type herein described it is desirable to have the compressor operate at lower temperatures so that the compressor operates most efficiently. Lubricating oil is therefore used to both lubricate the moving parts of the compressor and to cool the compressor in order to prevent overheating thereof. Heat transferred to the lubricating oil must be transferred from the oil out of the compressor. A conventional way of transferring the heat from the oil out of the compressor is to spray the oil onto the wall of the compressor housing whereby the housing absorbs the heat from the oil and the heat can then be transferred from the housing to the outside of the compressor by convection to the ambient air surrounding the compressor.

Conventional compressors in general comprise an electric motor and a crankshaft which is rotatably driven by the motor. An oil sump is generally located in the bottom portion of the housing and oil is drawn up therefrom by a crankshaft operated pump and is then conducted through a bore in the crankshaft to radial crankshaft passages to areas in need of lubrication. Excess oil travels further upwardly through the crankshaft bore and is then sprayed outwardly from the crankshaft at an upper portion thereof, and onto the housing to be cooled thereby. The oil runs down the walls of the housing and returns to the oil sump.

Many prior art arrangements have been provided for dispersing the oil from the crankshaft to the housing. In one such arrangement, disclosed in U.S. Pat. No. 3,451,615, an axially directed port and a radially directed port are provided for discharging oil from the crankshaft bore. These two ports are arranged so that centrifugal force discharges oil from the axial bore through the radial port at low crankshaft speeds and through both ports at higher crankshaft speeds. By providing a special notch located in the side of the shaft at the end of the radial bore, the oil is dispersed onto the wall of the upper housing. One problem with this arrangement is that often not all the oil is sprayed onto the housing. A portion of the oil is sprayed onto the shock loop of the discharge refrigerant tube whereby heat which is normally carried out of the compressor by the discharged refrigerant is transferred to the oil instead, and is therefore retained in the compressor. The result of this arrangement is an increase in the operating temperature of the compressor which adversely affects the compressor's efficiency.

In another prior art arrangement disclosed in U.S. Pat. No. 2,628,016 the crankshaft bore extends all the way through the crankshaft. A tube is secured into the upper portion of the bore. The tube is bent at an angle so that oil pumped upwardly through the crankshaft and exiting through the bore and the tube will be sprayed outwardly onto the wall of the compressor housing. While in this arrangement the bent tube can be arranged so that its upper end will extend above the shock loop tube of the compressor, this structure has not been satisfactory since the speed of the compressor varies with its loading. Thus, the speed with which the bent tube which is secured to the upper end of the crankshaft rotates will vary depending upon the compressor speed. The spray pattern of this dispersion arrangement varies with compressor speed and is therefore nonuniform thereby increasing the likelihood that not all the sprayed oil will reach the housing wall. An additional disadvantage of this arrangement is that the bent tube needs to be press fitted into the compressor crankshaft which adds labor and materials cost. In this arrangement it is also possible that the bent tube may work loose thereby causing early failure of the compressor. It is, therefore, desired to provide an arrangement eliminating the need for a special oil dispersion tube.

In yet another prior art arrangement disclosed in U.S. Pat. No. 2,504,528, the top portion of the compressor shell has been deformed so that it is in close proximity to the top of the crankshaft. Oil which is flung out of the bore in the top portion of the crankshaft is deflected by this deformation to run downwardly along the inner wall of the compressor shell. This arrangement also has not been satisfactory because oil sprayed from the top portion of the crankshaft bore is generally flung radially outwardly and does not have sufficient upward velocity to reach the top of the housing. Therefore, only a portion of the oil exiting from the top bore in this compressor will be deposited on the housing to be cooled thereby. It is therefore desired that substantially all the oil sprayed from the top portion of the crankshaft will be flung outwardly onto the housing to be cooled thereby.

In still other prior art arrangements the compressor bore angles radially outwardly at the top end of the compressor crankshaft, in order to impart additional centrifugal velocity to the oil as it is pumped upwardly through the bore of the compressor crankshaft. In these arrangements, insufficient upward velocity is imparted to the oil so that the centrifugal force acting on the oil will cause it to be flung generally radially outwardly of the compressor crankshaft rather than upwardly and onto the housing whereby only a portion of the oil will reach the housing. The remaining oil will be slung onto the working parts of the compressor so that heat is picked up by the oil and the compressor operating temperature will remain higher than is desirable. It is therefore desired that substantially all the oil slung outwardly from the crankshaft bore will be slung directly onto the wall of the compressor housing to be cooled thereby.

SUMMARY OF THE INVENTION

The present invention overcomes the above described problems and disadvantages associated with the prior art by providing, in one form thereof, a counterbore in the outboard bearing of the compressor. A radial aperture in the crankshaft opens into the counterbore whereby oil will pool in the counterbore and will cooperate with additional oil exiting from the radial crankshaft passage to deflect the oil positively upwardly and onto the wall of the compressor housing.

The invention, in one form thereof, comprises a crankshaft having a bore therein and a pumping mechanism located in the lower portion of the crankshaft. Oil s pumped upwardly through the crankshaft bore into an upper portion of the crankshaft where it is conducted outwardly through a radial passage in the crankshaft under centrifugal force. The outboard bearing, located in the plane of the crankshaft radial passage, has a counterbore formed therein surrounding the crankshaft. Oil exiting from the crankshaft will pool in the corner formed by the bottom surface of the counterbore and the side surface thereof. The pooled oil cooperates with the oil exiting from the radial passage to deflect the exiting oil in an upward direction onto the inside wall of the top portion of the compressor housing. The oil will then run downwardly along the housing and transfer its heat to the housing.

The present invention, in one form thereof, comprises an oil dispersing mechanism whereby oil which is slung outwardly from the compressor crankshaft through a radial passage therein is deflected upwardly from the outer wall of an annulus formed in the outboard bearing of the crankshaft and is deposited onto the housing of the compressor to transfer heat thereto.

An advantage of the present invention is that it provides a very simple yet very efficient method of cooling the lubricating oil of a compressor.

Another advantage of the present invention is that it provides a more efficient method for cooling the compressor lubricating oil whereby the compressor will operate at a lower temperature, and therefore will operate more efficiently.

Yet another advantage of the instant invention is that a very tight oil dispersion pattern is achieved which is not dependent on the speed of the compressor.

Still another advantage of the present invention is that substantially all the oil exiting from the compressor crankshaft will be sprayed directly onto the housing in heat transfer relationship therewith.

A further advantage of the present invention is that oil exiting from the compressor crankshaft will not be sprayed onto the shock loop of the compressor discharge tube but instead will be sprayed onto the wall of the compressor housing.

A yet further advantage of the present invention is that no extra parts are needed to provide a very efficient structure for cooling the compressor lubricating oil.

The invention, in one form thereof, comprises a compressor including a crankshaft and a bearing for journalling the crankshaft. Means are provided for cooling compressor lubricant comprising an axial bore in the crankshaft and means for pumping lubricant upwardly through the bore. An annular cavity is provided in the bearing concentric with and surrounding the crankshaft, the cavity being open upwardly and defining a circumferential shoulder spaced from the crankshaft. A radial passage is provided in the crankshaft, the passage being open at one end to the bore and open at its other end to the cavity, whereby lubricant passes radially outwardly through the passage and is deflected upwardly by the shoulder.

The invention, in one form thereof, further provides a compressor including a housing, a crankshaft, and a cage bearing for journalling the crankshaft. Means is provided for dispersing oil onto an upper inside wall portion of the housing, the means comprising an oil sump in the housing and an axial bore in the crankshaft communicating with the sump for pumping oil upwardly from the sump. A radial passage means is provided in an upper portion of the crankshaft, communicating with the bore for conducting oil radially outwardly of the crankshaft. A counterbore is provided in the cage bearing, coaxial with the crankshaft, the counterbore being coplanar with the plane wherein the radial passage is located. The outer wall of the counterbore cooperates with the radial passage for deflecting the outwardly conducted oil upwardly and onto the housing.

The invention, in one form thereof, still further provides a compressor having a housing, a crankshaft and a cage bearing for journalling the crankshaft. A discharge tube shock loop is located in an upper portion of the housing. Means are provided for cooling lubricant oil by dispersing the oil onto the housing. An oil sump is locating in a lower portion of the housing and an oil pump is connected to the crankshaft for pumping oil upwardly through an axial bore in the crankshaft. A counterbore is provided in the bearing coaxial with the crankshaft and located in a plane perpendicular to the crankshaft axis. The counterbore is open upwardly and has a greater diameter than the crankshaft and defines an annulus with the outer surface of the crankshaft. A radial passage means is provided in the crankshaft and opens into the annulus, for conducting oil from the bore to the annulus whereby oil is deflected upwardly over the shock loop by the outer wall of the annulus and onto the upper inner wall of the housing.

The invention, in one form thereof, still further provides a method for dispersing compressor lubricant in a compressor having a housing, a crankshaft, and a cage bearing. The method comprises pumping the lubricant upwardly through the crankshaft, slinging the lubricant radially outwardly at an upper portion of the crankshaft adjacent a bearing, and deflecting the lubricant in an upward direction with circumferential shoulder means located in the cage bearing.

It is therefore an object of the invention to provide a very simple efficient structure for cooling the lubricant in a compressor.

It is another object of the present invention to provide an improved oil cooling structure for a compressor whereby the compressor will run at a lower temperature.

Still another object of the present invention is to provide structure for dispersing oil in a compressor whereby the dispersion pattern is not speed dependent and is very predictable.

A yet further object of the present invention is to provide an oil dispersion structure for a compressor wherein the oil is sprayed in its entirety directly onto the housing of the compressor to be cooled thereby.

A still further object of the present invention is to provide an oil dispersion structure wherein the oil is not sprayed onto the shock loop of the refrigerator tubing.

A still other object of the present invention is to provide an oil dispersion structure wherein no extra parts are necessary for dispersing oil from a crankshaft onto the wall of the compressor housing.

Other objects, features and advantages of the present invention will become apparent in connection with the following description, the appended claims and the accompanying drawings in which:

Figure 1:
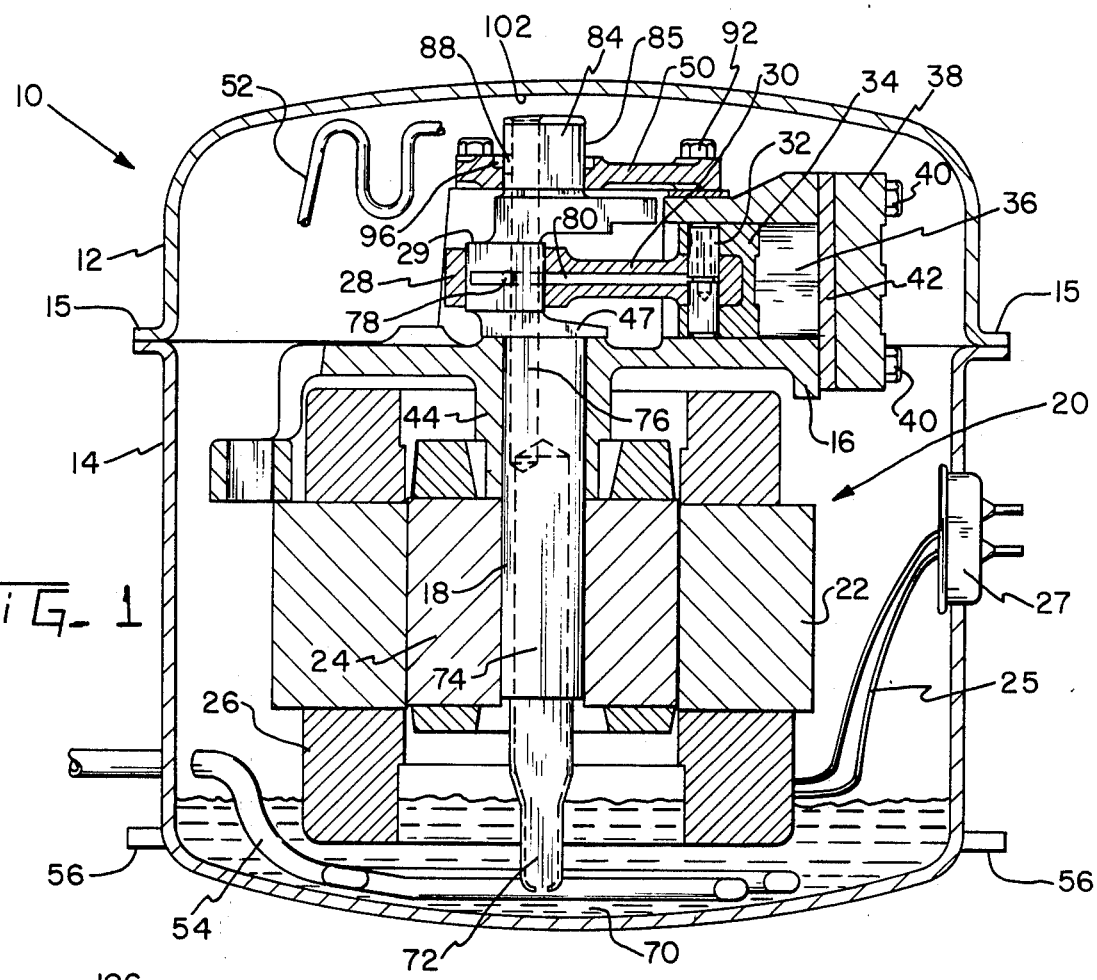
FIG. 1 is a vertical sectional view of a hermetically sealed compressor unit incorporating the lubrication cooling system of the present invention.
Figure 6:
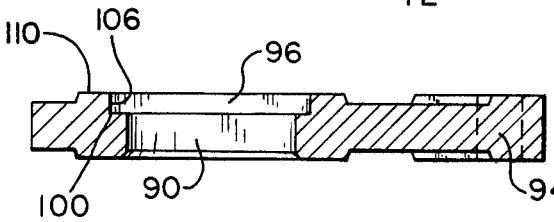
FIG. 6 is a side sectional view of the compressor outboard bearing taken along the line 6—6 of FIG. 5.

Referring now to the drawings and particularly to FIG. 1 a compressor is shown including a shell or housing 10 with an upper housing portion 12 and a lower housing portion 14. The upper and lower housing portions are sealingly secured together at seam 15 such as by welding or brazing. Mounted within the compressor housing 10 is a crankcase 16 having a crankshaft 18 rotatably received therein. A motor 20 comprising a stator 22 and a rotor 24 secured to crankshaft 18 provides the driving force for rotating crankshaft 18. Stator 22 is provided with stator windings 26 which are energized by means of leads 25 connected to electrical terminal connector 27, which is sealingly mounted in lower housing portion 14.

The upper portion of crankshaft 18 includes an eccentric 29 which is received in closed end loop 28 of connecting rod 30. The end of connecting rod 30 opposite the loop 28 is connected by means of wrist pin 32 to piston 34. Piston 34 is reciprocatingly received in cylinder 36 of crankcase 16. Cylinder 36 is sealed by means of a gasket 42 and cylinder head 38. Cylinder head 38 and gasket 42 are secured to cylinder 36 by means of bolts 40, four of which are provided in the illustrated embodiment. Crankshaft 18 is rotatably journalled in main bearing 44 and outboard bearing 47. A counterweight 48 is provided at the upper portion of crankshaft 18 to dynamically balance the piston cylinder and crankshaft arrangement.

Figure 2:
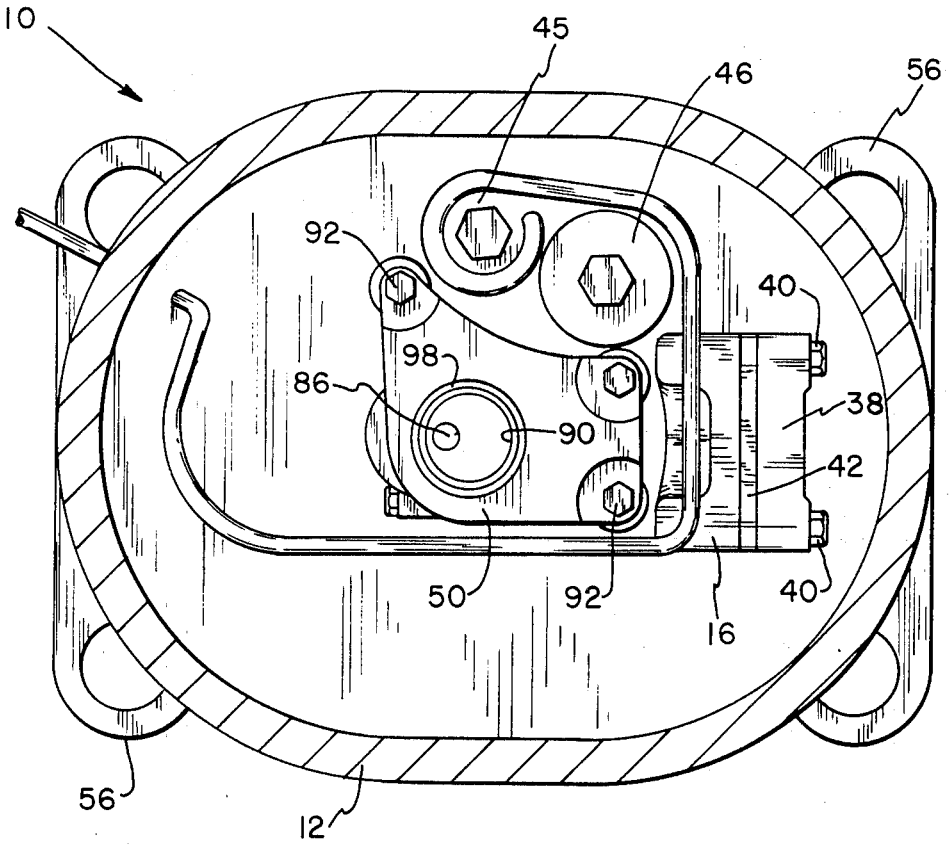
FIG. 2 is a plan view of the compressor unit of FIG. 1.
Figure 4:
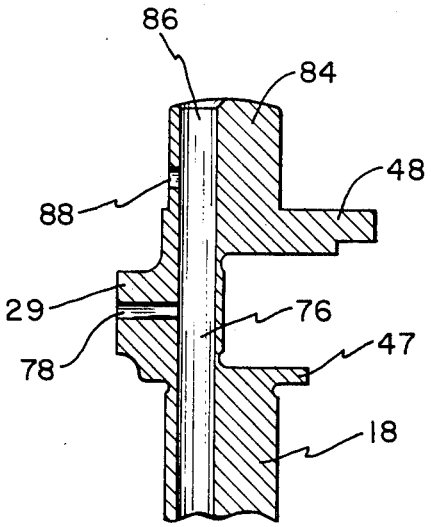
FIG. 4 is a fragmentary side sectional view of the top portion of the compressor crankshaft.

As best seen in FIGS. 1 and 2 refrigerant enters compressor cylinder 36 by way of a suction muffler (not shown) and after compression in cylinder 36 is discharged through discharge muffler 46 and a discharge shock loop 52 located adjacent crankcase 16. As is well known in the prior art, refrigerant is elevated in temperature by compression so that, during operation of the compressor, refrigerant shock loop 52 will be at high temperatures. It is desirable that the heat contained in the refrigerant in shock loop 52 is transferred outside the compressor instead of being retained therein as will be further discussed hereinbelow.

Mounting bracket 56 is secured to housing shell lower portion 14 near the bottom thereof as best illustrated in FIGS. 1. Mounting bracket 56 serves the purpose of mounting the compressor in a refrigeration apparatus such as refrigerator, freezer, air conditioner and the like. Disposed in lower portion 14 of the housing 10, along with refrigerant oil cooler tube 54, is an oil pump 72 comprising a hollow tube connected to the bottom end portion of crankshaft 18. Hollow tube oil pumps are conventional and well known in the prior art. In general tube 72 is press fit into a bore 74 of crankshaft 18. Oil pump 72 extends into oil sump 70 containing oil as illustrated. Oil pump tube 72 pumps oil upwardly from sump 70 as the crankshaft rotates and pumps the oil upwardly into axial bore 74 in crankshaft 18. Crankshaft 18 also includes oil passage 76 which extends upwardly from bore 74 and which traverses the entire length of upper portion 84 of crankshaft 18.

Crankshaft 18 includes radial oil passage 78 located in eccentric 29 whereby oil in oil passage 76 will pass radially upwardly through radial oil passage 78 to lubricate closed loop end 28 of crankshaft 18. Connecting rod 30 also contains an oil passage 80 through which oil will travel from closed loop end 28 to lubricate wrist pin 32.

Lubricating oil being distributed through the oil passages, as described, serves two purposes namely to lubricate the working surfaces of the compressor and to cool those surfaces. During operation of the compressor very high temperatures exist within the housing of the compressor due to heat generated by operation of the motor, friction of the working surfaces of the compressor and the compression of refrigerant. As explained hereinabove, when refrigerant is compressed its temperature will rise. It is important both from the standpoint of extending the life of the compressor and for efficient operation of the compressor that the temperatures within the compressor remain at acceptable levels. The cooling function of the lubricant therefore is extremely important for both those reasons and heat transferred from the compressor working parts to the lubricant must be transferred from the lubricant outside the compressor to the ambient environment. As explained hereinbefore, one method of achieving cooling of compressor lubricant is to spray the lubricant onto inside wall 102 of the compressor housing 10 at upper portion 12 thereof and to allow the lubricant to run downwardly along the compressor housing wall to sump 70. The contact of the lubricant with the relatively cooler housing shell 10 of the compressor will transfer heat from the oil to compressor housing 10 from which the heat it is then transferred by convection to the ambient environment outside of the compressor. It is therefore desired that the transfer of lubricant from crankshaft 18 to wall 102 of upper portion 12 of housing 10 is accomplished efficiently so that substantially all lubricant sprayed from crankshaft 18 will reach housing 10 without being intercepted by other portions of the compressor. It is especially desirable that lubricant be deflected over shock loop 52 because, if lubricant were sprayed onto shock loop 52, heat, which is normally carried out of the compressor by the discharged, refrigerant would be transferred to the lubricant and would be retained in the compressor. The structure herein described assures that lubricant is deflected over shock loop 52 and is sprayed directly onto the upper housing 12.

Figure 5:
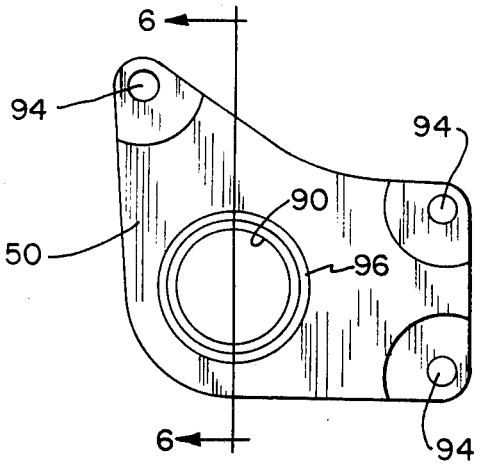
FIG. 5 is a plan view of the compressor outboard bearing.

Referring further to FIGS. 1, 2 and 5, outboard or cage bearing 50 is secured to crankcase 16 by means of bolts 92 three of which are provided. Bolts 92 pass through apertures 94, in bearing 50 and are received in suitable threaded apertures in crankcase 16. Bearing 50 has a bearing aperture 90 in which upper portion 84 of crankshaft 18 is journalled. Bearing 50 is also provided with a counterbore 96 with opening 90. Counterbore 96 has a larger diameter than upper crankshaft portion 84 whereby wall 106 of counterbore 96 forms an annulus 98 together with outer cylindrical surface 85 of upper portion 84 of crankshaft 18 as best illustrated in FIG. 3.

Figure 3:
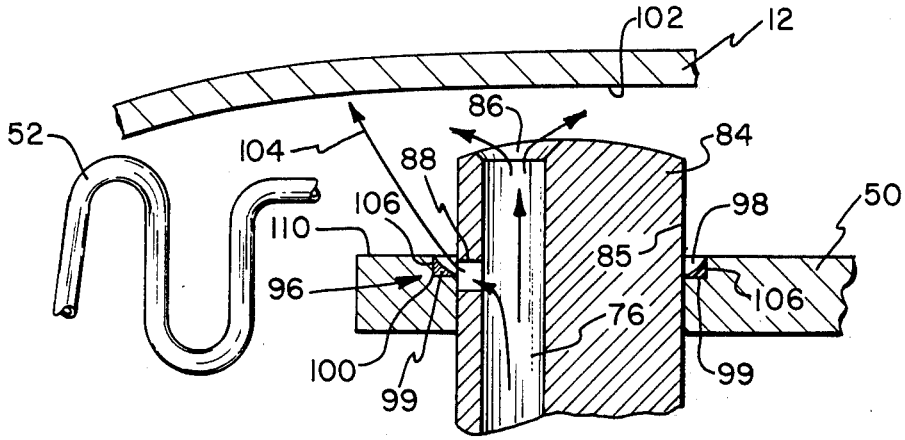
FIG. 3 is an enlarged fragmentary sectional view of the top portion of the crankshaft, the shockloop, the outboard bearing and the housing of the compressor.

In operation, as illustrated in FIG. 3, oil will travel upwardly through oil passage 76 in upper portion 84 of crankshaft 18. A portion of the oil will be slung outwardly through radial oil passage 88 into annulus 98. Oil will collect in corner 100 of annulus 98 and will pool therein as indicated by shaded portion 99. Additional oil passing outward of passage 88 will be deflected upwardly from the surface of oil trapped in corner 100 and will then pass upwardly over shock loop 52 directly onto wall 102 of upper housing 12 as indicated by arrow 104. It can therefore be seen that the combination of the annulus 98 formed by counterbore 96 and outer surface 35 of crankshaft 18 will form a step portion for trapping oil 99 to aid in deflecting oil passing outwardly of passage 88 in crankshaft 18. The advantages of this construction are the simplicity of the structure, since no additional parts are necessary, as will the predictably tight pattern with which the oil is deflected upwardly regardless of compressor loading. As the crankshaft rotates, passage 88 will rotate therewith so that oil will be sprayed in a 360° cone shaped pattern onto wall 102. This pattern is relatively independent of loading of the compressor and attendant reduction in speeds of compressor crankshaft 18.

During initial startup when the compressor temperatures are still not at operating levels and the lubricant is still relatively viscous, oil will pool on top of the outboard bearing as it flows out of annulus 98. The pooled oil will break up oil passing outwardly of passage 88 preventing it from being sprayed onto wall 102. However, as the oil pool warms up and the viscosity of the oil increases it will be deflected freely by annulus 98 and will be sprayed onto wall 102.

Some oil will also flow upwardly through passage 76 and out of upper aperture 86. As oil leaves aperture 86, it will be spun sideward by centrifugal force whereby most of this oil will not reach wall 102, but will instead be flung onto the crankcase and the outboard bearing to cool the surfaces thereof after which it will drip downward into the sump.

To reiterate, the provision of counterbore 96 in the plane of crankshaft radial passage 88 causes oil to be deflected in a tight pattern directly onto wall 102 of upper housing portion 12 bypassing shock loop 52 whereby the lubricant is cooled in an efficient manner and will run down over the inside wall of the compressor housing 10 and back into sump 70.

While this invention has been described as having a specific embodiment it will be understood that it is capable of further modification. This application is therefore intended to cover any variations, uses, or adaptations of the invention following the general principles thereof, and including such departures from the present disclosure as come within known or customary practice in art to which this invention pertains and fall within the limits of the appended claims.

What is claimed is:

1. In a hermetic compressor including a housing and rotatable vertical crankshaft and a bearing for journalling said crankshaft, means for cooling compressor lubricant oil comprising:

an axial bore in said crankshaft;

means for pumping oil from an oil sump upwardly through said bore;

an annular cavity in said bearing concentric with and surrounding said crankshaft, said cavity being open upwardly through substantially 360° towards said housing and defining a circumferential shoulder spaced radially outwardly from the outer surface of said crankshaft; and a radial passage in said crankshaft, said passage open at one end to said bore and open at the other end to said cavity, whereby oil passes radially outwardly through said passage into said cavity as said crankshaft rotates and is deflected upwardly through substantially 360° towards said housing by said shoulder.

2. The compressor of claim 1 wherein said housing has an inside wall of an upper portion thereof in close proximity to said bearing whereby said oil is deflected onto said wall.

3. The compressor according to claim 1 including a compressor discharge line shock loop located in an upper portion of said compressor radially outwardly of said bearing and wherein said oil is substantially completely deflected away from said shock loop.

4. The compressor according to claim 1 wherein said means for pumping oil upwardly through said bore comprises an oil pump connected to a bottom portion of said crankshaft, said pump extending into said oil sump.

5. The compressor according to claim 1 wherein oil pools in said cavity against said shoulder.

6. In a hermetic compressor including a housing, a rotatable vertical crankshaft and a cage bearing for journalling said crankshaft, means for dispersing oil onto an upper inside wall portion of said housing comprising:

an oil sump in a lower portion of said housing;

an axial bore in said crankshaft communicating with said sump for pumping oil upwardly from said sump through said bore;

radial passage means in an upper portion of said crankshaft communicatwng with said bore for conducting oil radially outwardly of said rotatable crankshaft;

a counterbore in said cage bearing coaxial with said crankshaft and open through substantially 360° towards said housing, said counterbore and said radial passage being coplanar, the outer wall of said counterbore spaced radially outwardly from the outer surface of said crankshaft and cooperating with said radial passage for deflecting said outwardly conducted oil upwardly through a substantially 360° arc and onto said housing.

7. The compressor according to claim 6 wherein oil passing radially outwardly of said passage into said counterbore pools against said counterbore outer wall.

8. The compressor according to claim 6 wherein a discharge tube shock loop in the upper portion of said housing radially outwardly of said bearing is substantially outside the path of the deflected oil.

9. In a hermetic compressor having a housing, a crankshaft and a cage bearing for journalling said crankshaft, a discharge tube shock loop located in an upper portion of said housing, means for cooling lubricant oil by dispersing said oil onto said housing comprising:

an oil sump located in a lower portion of said housing;

oil pump means connected to said crankshaft for pumping oil upwardly through an axial bore in said crankshaft;

a counterbore in said bearing, coaxial with said crankshaft, said counterbore being open upwardly through substantially 360° towards said housing and having a greater diameter than the diameter of said crankshaft and having an outer wall for defining an annulus with the outer surface of said crankshaft;

a radial passage means in said rotatable crankshaft and communicating with both said annulus and said axial bore for conducting oil from said bore to said annulus, whereby oil is deflected through a substantially 360° upwardly over said shock loop by said outer wall of said annulus and onto the inner surface of an upper wall of said housing.

10. The compressor according to claim 9 wherein oil pools in said annulus.

11. The structure according to claim 9 wherein said upwardly deflected oil flows downwardly from said upper wall to said oil sump thereby cooling said oil.

12. The method of dispersing compressor lubricant in a compressor having a housing, a rotatable vertical crankshaft, and a cage bearing, the method comprising the steps of:

rotating said crankshaft;

pumping lubricant upwardly through said crankshaft;

slinging said lubricant radially outwardly at an upper portion of said crankshaft adjacent said bearing; and deflecting said lubricant in an upward direction through a substantially 360° from a circumferential shoulder means located in said cage bearing.

13. The method according to claim 12 wherein said deflected oil is slung onto an inside surface of an upper wall of said housing and returning said oil to an oil sump located in a bottom portion of said housing.

* * * * *

UNITED STATES PATENT AND TRADEMARK OFFICE

CERTIFICATE OF CORRECTION

PATENT NO. : 4,576,555

DATED : March 18, 1986

INVENTOR(S) : Roger N. Ashenfelter

It is certified that error appears in the above-identified patent and that said Letters Patent is hereby corrected as shown below:

Col. 6, line 44, change "discharged, refrigerant" to --discharged refrigerant,--.

Claim 6, Col. 8, line 29, change "communicatwng" to --communicating--.

Claim 9, Col. 8, line 68, insert --arc-- after "360".

Claim 12, Col. 10, line 6, insert --arc-- after "360".

Signed and Sealed this

*Twelfth* Day of *August 1986*

[SEAL]

*Attest:*

DONALD J. QUIGG

*Attesting Officer*

*Commissioner of Patents and Trademarks*